United States Patent [19]

Prins

[11] 4,387,004

[45] Jun. 7, 1983

[54] SEAL FOR A COKE OVEN DOOR

[75] Inventor: Klaar Prins, Velsen-Zuid, Netherlands

[73] Assignee: Estel Hoogovens B.V., Ijmuiden, Netherlands

[21] Appl. No.: 308,822

[22] Filed: Oct. 5, 1981

[30] Foreign Application Priority Data

Oct. 8, 1980 [NL] Netherlands ..... 8005548

[51] Int. Cl.[3] ..... C10B 25/16; C10B 29/06

[52] U.S. Cl. ..... 202/248; 202/268; 202/269

[58] Field of Search ..... 202/248, 268, 269; 110/173 R; 49/480–483, 485, 490

[56] References Cited

U.S. PATENT DOCUMENTS

| | | | |
|---|---|---|---|
| 2,007,318 | 7/1935 | Wilhelm | 202/248 |
| 2,778,784 | 1/1957 | Otto | 202/248 |
| 3,711,380 | 1/1973 | Teplitz | 202/248 |
| 4,067,778 | 1/1978 | Van Ackeren et al. | 202/248 |
| 4,216,061 | 8/1980 | Blase | 202/248 |

FOREIGN PATENT DOCUMENTS

| | | | |
|---|---|---|---|
| 46-5586 | 2/1971 | Japan | 202/248 |
| 51-16041 | 5/1976 | Japan | 202/248 |

*Primary Examiner*—Bradley Garris

*Attorney, Agent, or Firm*—Stevens, Davis, Miller & Mosher

[57] ABSTRACT

To seal against the surround of the door opening of a coke oven, the door has an elongate knife-edge element which engages the surround and is held against a sealing surface on the side of the door. The knife edge element is movable past the sealing surface on the door for adjustment. The knife-edge element is divided into a plurality of mutually abutting parts in the adjustment direction. In order to allow a greater amount of adjustment of the knife edge element and to make assembly of the seal easier, holding means e.g. a plurality of brackets, are provided to hold the parts of the knife edge together in the adjustment direction and to restrain at least the outermost part from lateral movement relative to the door. The holding means permits relative sliding of the parts in the longitudinal direction.

9 Claims, 6 Drawing Figures

SEAL FOR A COKE OVEN DOOR

BACKGROUND OF THE INVENTION

1. Field of the Invention

The invention relates to a seal for a door for a coke oven comprising an elongate knife edge element having a knife edge which, in the closed position of the door, engages a sealing surface on the surround of the coke oven opening, the knife-edge element being urged by pressing means against a sealing surface on the side of the door. The invention also relates to a coke oven door provided with such a seal and to a coke oven provided with the door.

2. Description of the Prior Art

A conventional seal of the above type is illustrated in FIG. 2 of the accompanying drawings and will be described in more detail below.

The purpose of this seal is to prevent leakage of gas from the coke oven to the atmosphere. Difficulty in sealing is primarily due to the frame of the coke oven and the frame of the door itself becoming deformed as a result of (a) long term distortions during the life of the door and the oven and (b) short term distortions arising during the heating of the coke oven in operation. Conventionally, leakages are dealt with by striking the back of the knife edge element at the point of the leak, so that it shifts relative to the door. This is an inconvenient and labour-intensive operation and it can be difficult to deal in this way with leaks which are the result of short-term distortion.

A considerable effort has been put, in recent years, into development of a membrane type seal, in which the knife edge element is not pressed against a sealing surface on the door, but is sealingly connected to the door by a resilient membrane. Such an arrangement may allow the knife edge element to be resiliently urged towards the sealing surface on the surround of the coke oven opening, but suffers the considerable disadvantages (a) that there is still only a limited ability to accommodate deformations, e.g. a deformation of 20 mm only and (b) that there is a high risk of damage of the thin membrane, bearing in mind that the door is very heavy and lacks accurate guidance and must also be vigorously cleaned.

The present invention is not concerned with membrane type seals, but with seals of the kind described at the beginning of this specification. U.S. Pat. No. 2,778,784 describes a seal of this kind in which the knife edge element is divided into a plurality of longitudinally extending parts which abut each other. The purpose of this is to increase the flexibility of the sealing element, so that it can better conform to the frame of the coke oven. The method illustrated for adjusting the element is striking it with a tool, as described above. The present applicants are not aware that a seal of this construction has ever been used in practice, and it can be seen to suffer from the disadvantage that the knife edge element can only be adjusted relative to the door over a limited distance. If the knife edge element is extended too far out from the door, in order to accommodate large distortions (e.g. 3 to 4 cm as may occur with a door 7 m in height), it will lose its support and its front portion will be liable to be displaced laterally, breaking the seal.

The object of the present invention is to provide a seal which is capable of accommodating large distortions of the coke oven frame and yet is simple and robust in construction. Preferably the seal is easily assembled and disassembled to and from its working position and preferably also it is self-adjusting so as to follow distortions which occur.

In the seal of the present invention, the knife edge element is, as in U.S. Pat. No. 2,778,784, divided into a plurality of abutting parts which extend longitudinally. Furthermore, holding means are provided to hold the parts against movement relative to each other in the adjustment direction and to restrain at least the outermost of the parts (i.e. the part which presses against the sealing surface on the surround of the coke oven opening) against movement relative to the door in the lateral direction. At the same time relative longitudinal sliding of the parts upon flexure of the knife edge element must be permitted. The lateral restraint of the outermost part is independent of the sealing surface on the side of the door against which the knife edge element is pressed.

In order to provide a structure which is easily assembled into the working position, the said holding means is preferably in the form of a plurality of brackets which are mounted on the knife edge element at longitudinally spaced points, each bracket embracing the parts of the knife edge element so as to prevent their movement apart in the adjustment direction, and being secured to one of the parts, preferably the outermost part.

In a preferred embodiment, the length, in the adjustment direction, of the said sealing surface on the door against which the knife edge element is urged by said pressing means, is less than 25% of the width of the knife edge element in the adjustment direction, and there are provided, spaced apart longitudinally along the knife edge element, a plurality of spring members which urge the knife edge element towards the sealing surface on the surround of the coke oven opening. The use of a narrow sealing surface on the door in this way is highly advantageous, because the surfaces at this seal tend to become dirtied by resinous products from the coal being coked in the oven. With a relatively small sealing surface, the resultant adhesive forces which tend to prevent movement of the knife edge element are much reduced. The important result is that it is therefore possible to use a plurality of spaced apart spring members to urge the knife edge element in the adjustment direction against the surround of the coke oven opening. In this way a self-adjusting seal can be made, which follows distortion of the surround. The unsatisfactory method of striking the seal to adjust it is thus rendered unnecessary. It has been found that the seal in accordance with the invention can be designed to easily follow bending of 40 mm, so that leaks resulting from short term distortion are also properly sealed. The seal according to the invention can be applied to existing coke ovens.

BRIEF DESCRIPTION OF THE DRAWINGS

Further preferred features and possible advantages of the invention will be seen from the following description given by way of example, of two preferred embodiments of the invention.

In the drawings.

DESCRIPTION OF THE PREFERRED EMBODIMENTS

Figure 1:
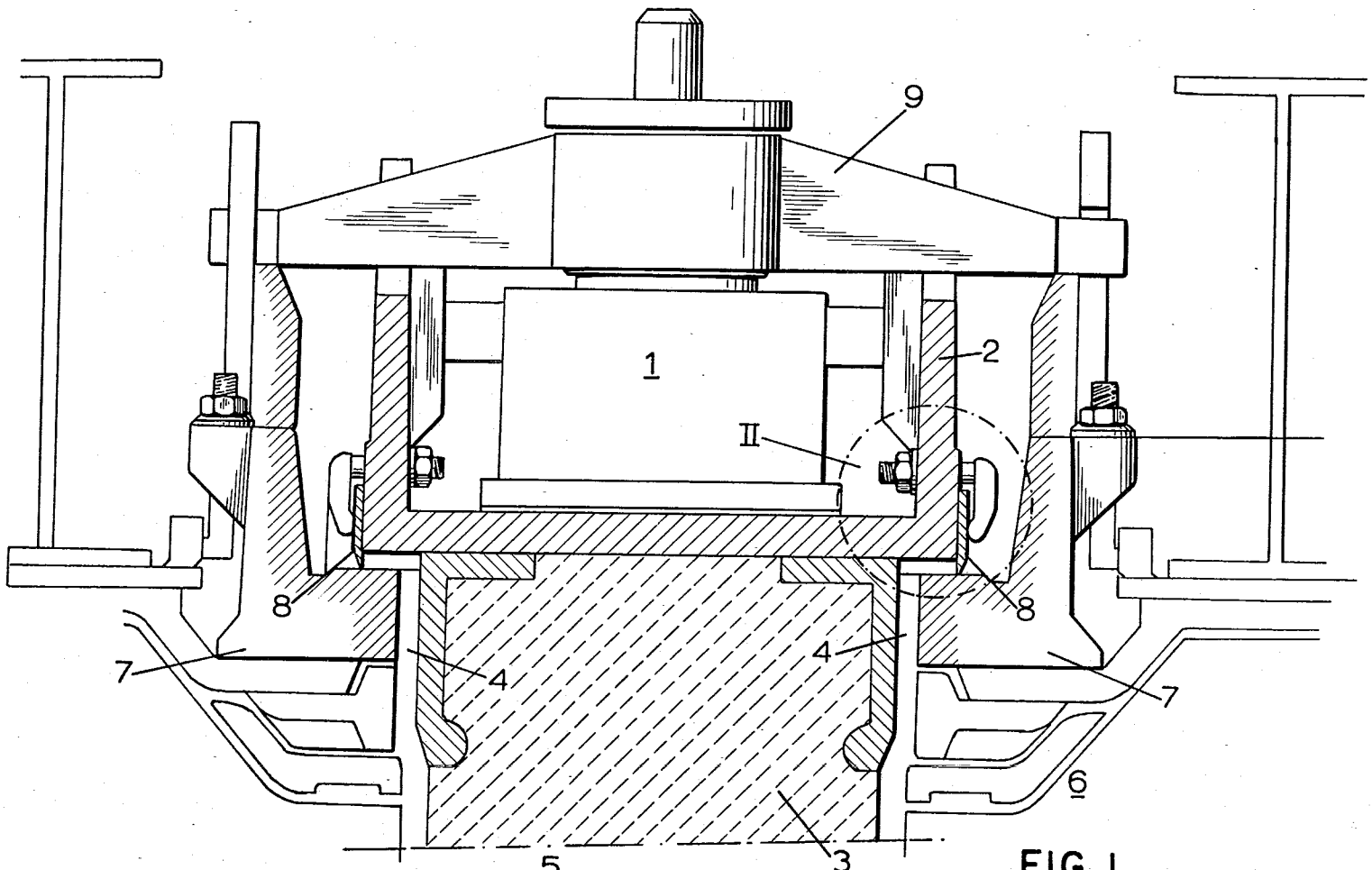
FIG. 1 PRIOR ART
FIG. 1 is a general horizontal cross section through a coke oven door which sealingly cooperates with a coke oven.

FIG. 1 shows a coke oven door 1, comprising a frame 2 and a refractory body 3 which projects in the closed position of the door as shown, into a door opening 4 in the coking chamber 5 of a coke oven 6. The opening 4 is surrounded by a frame 7. In the conventional design of the seal between the coke oven door and the surround of the coking chamber, the door carries at its sides knife edge elements 8 which press against the frame 7. The door is forcibly pushed against the frame 7 by means of the cross bars 9.

Figure 2:
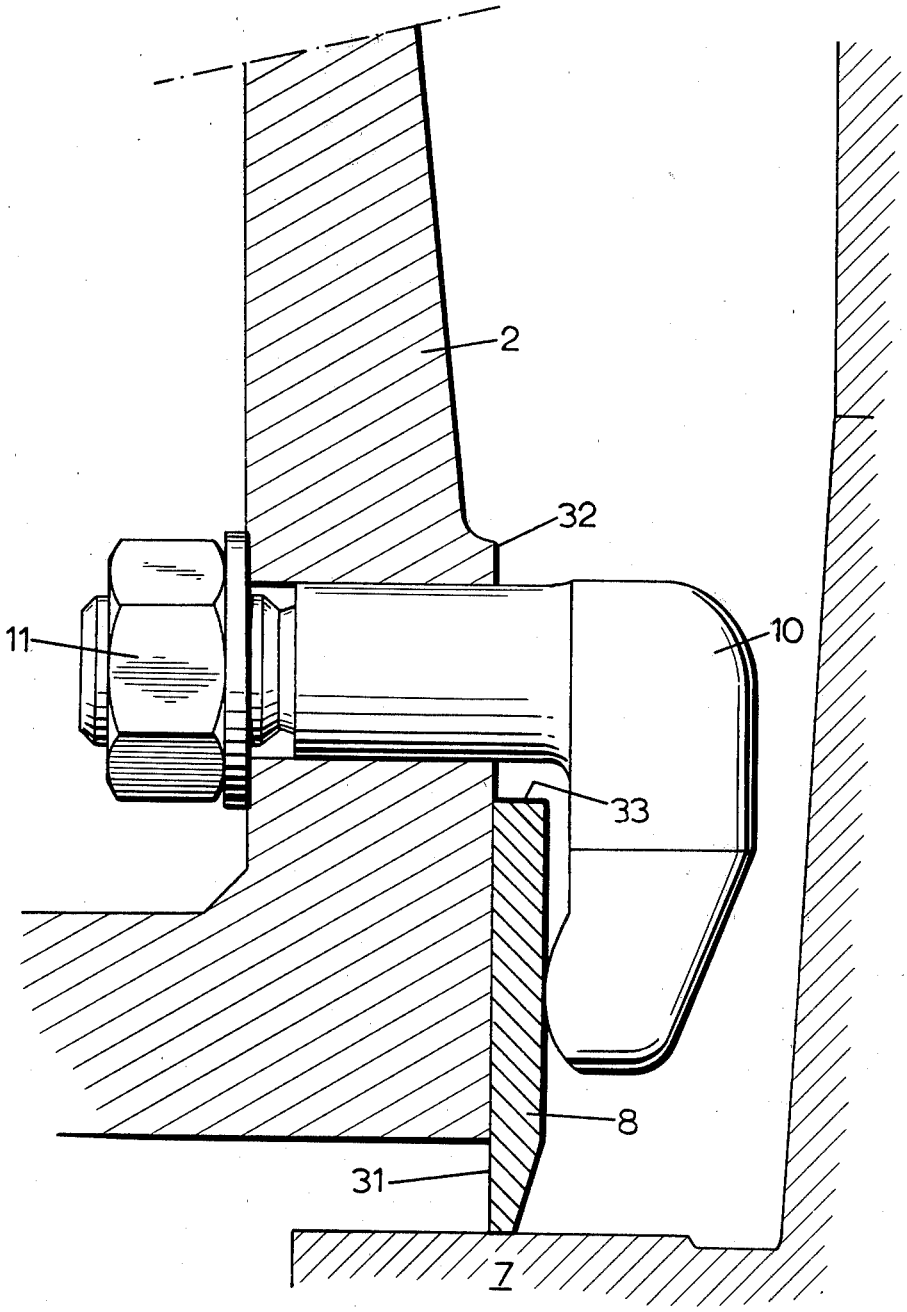
FIG. 2 PRIOR ART
FIG. 2 shows, on larger scale, the conventional seal of a coke oven door indicated as detail II in FIG. 1.

FIG. 2 shows this conventional construction of the knife edge elements 8 to the frame 2 of the door, the element 8 being pressed so that one side 31 lies against a side surface 32 of the door by pressing devices 10. The pressing devices are fastened to the frame 2 of the coke oven door by nuts 11. Gaps causing leaks between the knife edge element 8 and the frame 7 are remedied by striking the rear edge 33 of the knife edge element, so that it moves relative to the door past the surface 32. It will be seen that the knife edge element has a narrow front edge, though this is not actually an apex.

Customary dimensions of the coking chamber are 0.5 m wide and 4 to 7 m high. The door is pressed against the frame 7 by two of the cross bars 9. The door is provided with the knife edge elements 8 which are pressed against the door by the devices 10, e.g. every 15 cm. The knife shaped element is for example 75 mm in width (i.e. from front edge to back edge) and 10 mm thick. The material used is for example carbon steel. The knife edge of the element 8 desirably is able to project e.g. a minimum of 10 mm and a maximum of 50 mm beyond the frame of the door (i.e. the front edge of the supporting surface 32,) so that the element 8 can accommodate distortion of 40 mm.

Figure 3:
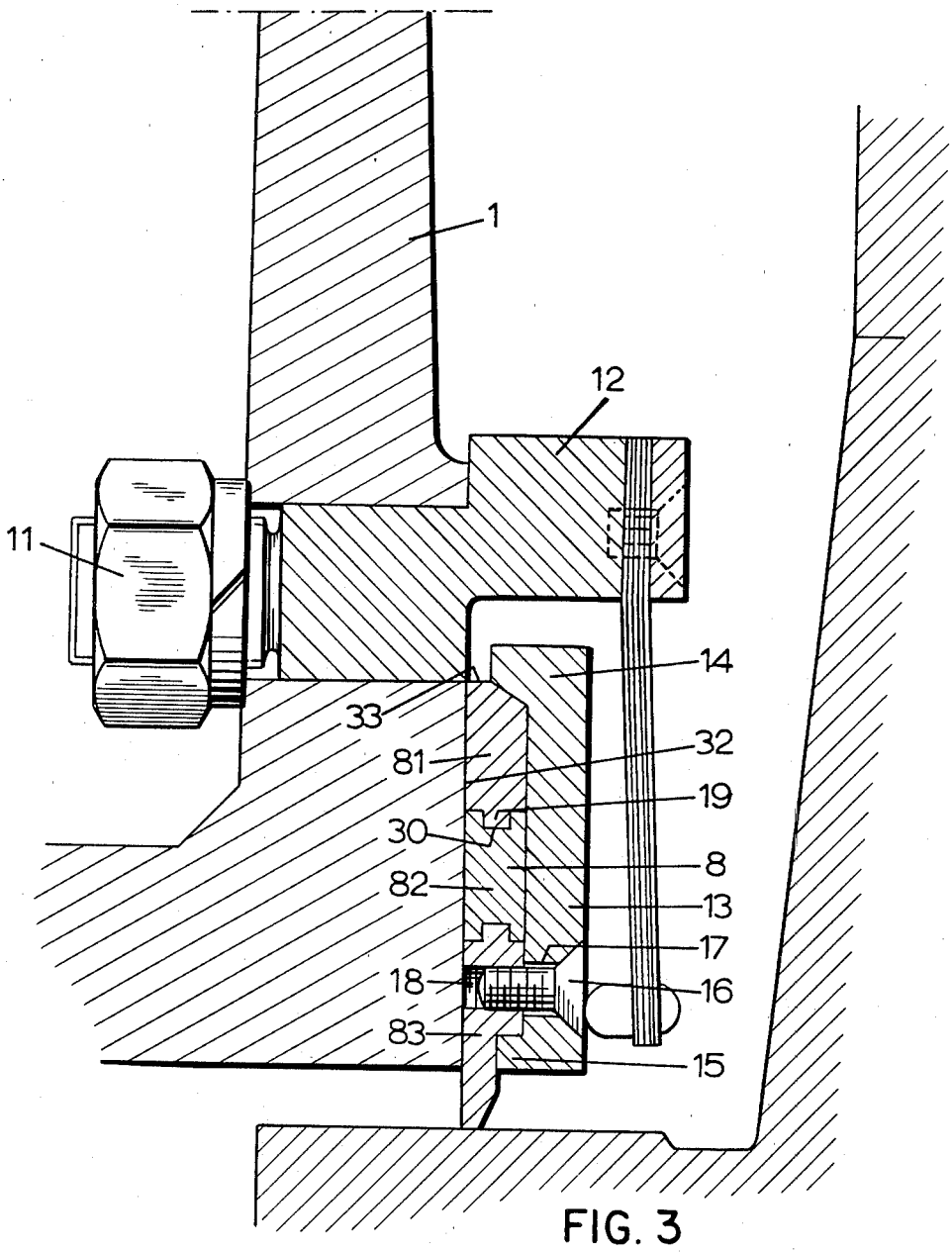
FIG. 3 shows, again in horizontal cross section, a seal of a coke oven door embodying the invention.
Figure 4:
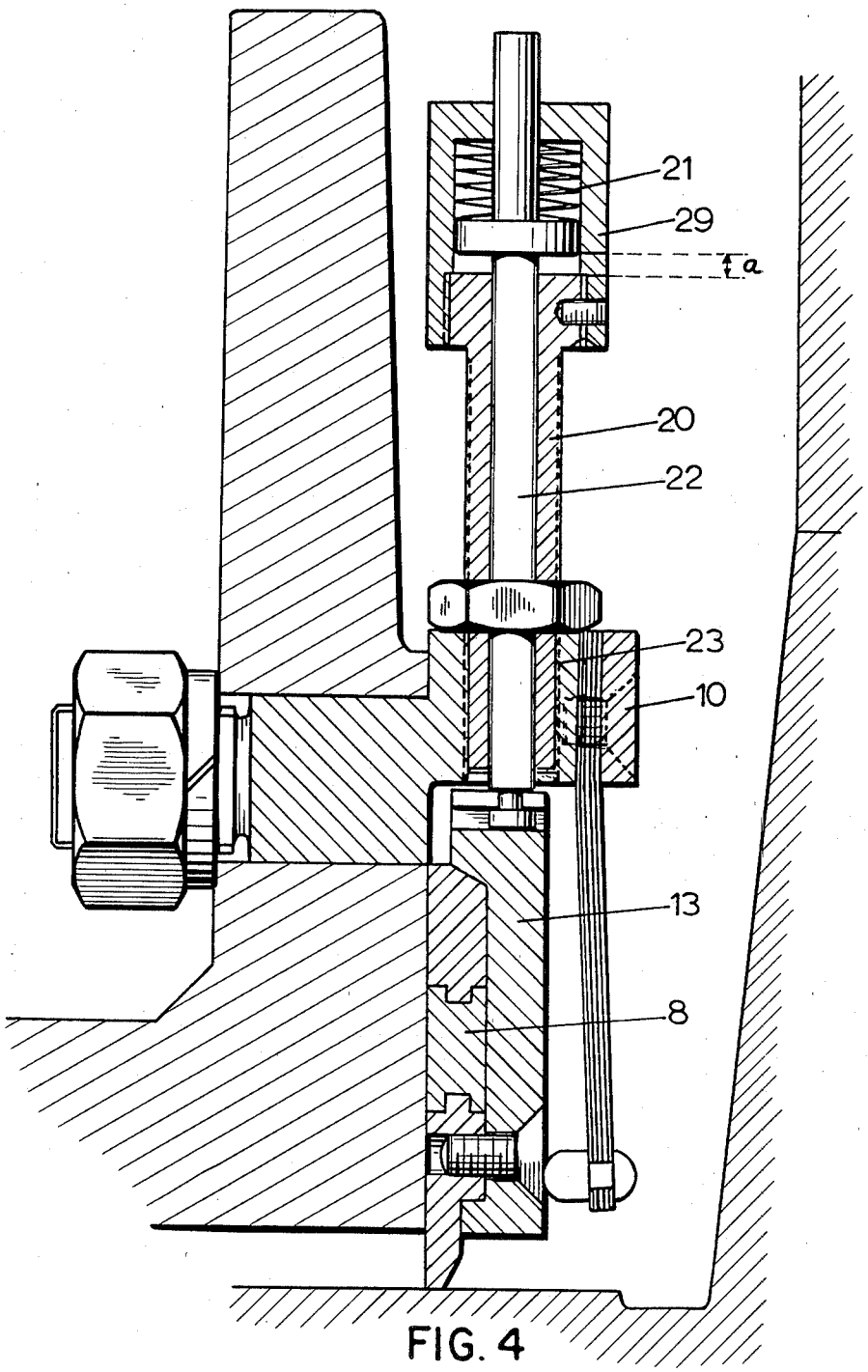
FIG. 4 is a section view corresponding to that of FIG. 3 of a seal which is a variant of the seal of FIG. 3.

In FIGS. 3 and 4, the same reference numerals are used for the same parts as in FIGS. 1 and 2.

The seal in accordance with the invention shown in FIG. 3 has a knife edge element 8 which is divided across its width into a plurality of longitudinal parts 81,82,83. In this case there are three parts, which is the preferred number. The knife edge element is pressed against the side surface 32 of the coke oven door 1 by spring pressing device 12. In the retracted state of the knife edge element as portrayed, all three parts 81,82,83 rest against the surface 32 of the door, but in the extended state, only two parts 81,82 or even only the innermost part 81 rest against the surface 32.

In order to hold the parts 81,82,83 together in the adjustment direction (i.e. the direction towards and away from the door surrounding frame 7), a plurality of brackets 13 are mounted on the knife edge element 8, at locations spaced apart longitudinally of the element 8 (see FIG. 6, to be described below). Each bracket 13 is a plate shaped member having flanges 14,15 at its outer and inner edges, so as to embrace the parts 81,82,83 to hold them together. Each bracket 13 is secured to one of the parts, in this case the outermost part 83 by a bolt 16 which passes through a hole 17 with clearance into a screw-threaded hole 18 in the part 83.

The bolt 16 also serves partly to restrain the part 83 against lateral displacement.

Further means for keeping the parts of the knife edge element together in the lateral direction are projections 19 and corresponding recesses 30 on adjacent pairs of these parts. This can be done to only one pair, but preferably to all the parts. Many shapes are possible for the projection 19 and the recess 30, but even though a flat metal on metal seal on a part surface is sufficient in principle in order to avoid leaks there is special preference for those embodiments which also contribute towards a gas-tight seal between the parts. There is a particular preference for a tongue and recess design as shown in the diagram.

The spring pressing devices 12 press against the respective brackets 13 to hold the assembly of the element 8 and brackets 13 against the sealing surface on the side of the door.

It can be seen therefore that the parts 81,82,83 are constrained to maintain contact with each other in the adjustment direction and with the side of the door laterally, by the combination of the pressing devices 12, the brackets 13 and the tongue and groove connections 19,30. The knife edge element can thus be extended a large distance towards the frame 7 beyond the edge of the door, without a danger that the outermost part 83 becomes disconnected. At the same time, the parts 81,82,83 can slide longitudinally relative to one another in order to flex in the adjustment direction, so as to accommodate distortions of the door or the frame 7. The brackets 13, being mounted on the element 8, permit this flexure.

The seal of FIG. 3 can be aplied in the same way as the known seal. Leaks can be remedied by knocking on the back edge 33 of the knife-edge element 8. Good sealing can be achieved.

The seal of FIG. 3 can also be pressed against the frame 7 by spring force by means of spring devices 29, such as shown in FIG. 4. These spring devices are spaced apart longitudinally of the element 8. Many variants of this spring device are conceivable. The sealed design shown is intended to avoid pollution as much as possible.

Threadedly mounted on the arm 12 (carrying the spring) is a sleeve 20 carrying at its rear end an assembly of belleville springs. A pin 22 passing through the sleeve 20 is loaded by the belleville springs and at its forward end presses on the knife edge element 8 via the bracket 13. The housing 20 has the external screw thread 23 so that it can, by turning, be adjusted in relation to the arm 10 so that a desired spring pressure can be exercised by it on the element 8 whatever the position of the element 8. After the spring pressure has been adjusted, the pin 22 has a clearance "a" which is taken up if the door of the coke oven is removed from its closed position. This means that, when the door is replaced at the coking chamber, a positive sealing force is brought to bear at the seal. Another important point is that, in this way, the knife edge element is moved relative to the side of the door once per coking period, so that the tendency of the knife edge elements to seize up through dirt is reduced.

It will be appreciated also that the assembly of the parts 81,82 and 83 and the brackets 13 can be put into position and removed as a unity and very simply.

Figure 5:
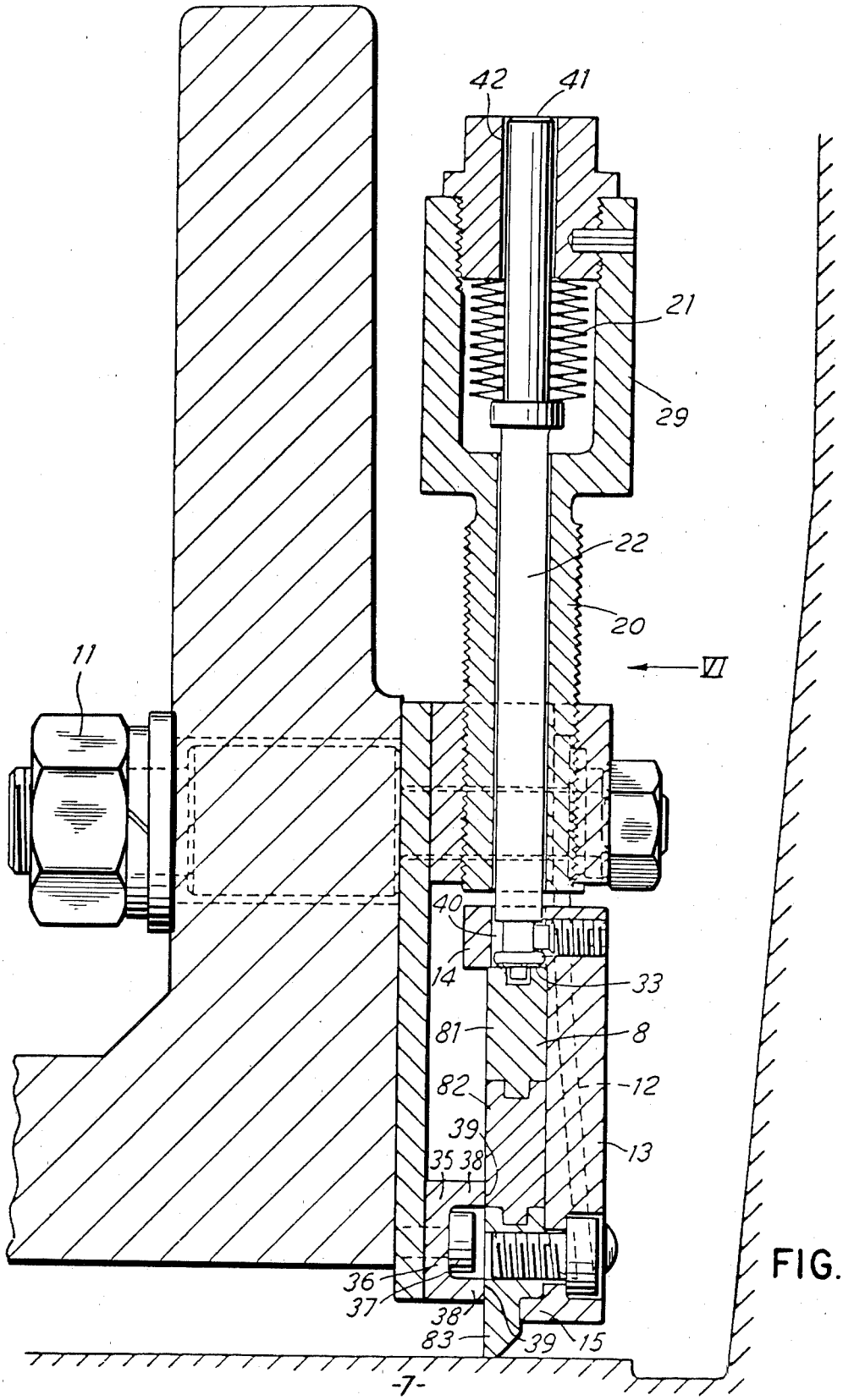
FIG. 5 is a sectional view, corresponding to that of FIG. 4, of the seal forming a second embodiment of the invention, on the line V—V in FIG. 6.

The problem of seizure of the seal due to adhesion caused by deposits on the sealing surfaces between the element 8 and the door can be considerable. The embodiment of FIGS. 5 and 6 particularly avoids this. In these figures the same reference numbers are used for corresponding parts as in FIGS. 2 to 4. FIGS. 5 and 6 show an embodiment in which the lateral spring pressure devices 12 and the brackets 13 with the spring devices 20,21,22 alternate along the element 8. In this case the spring devices 12 bear directly on the element 8.

Figure 6:
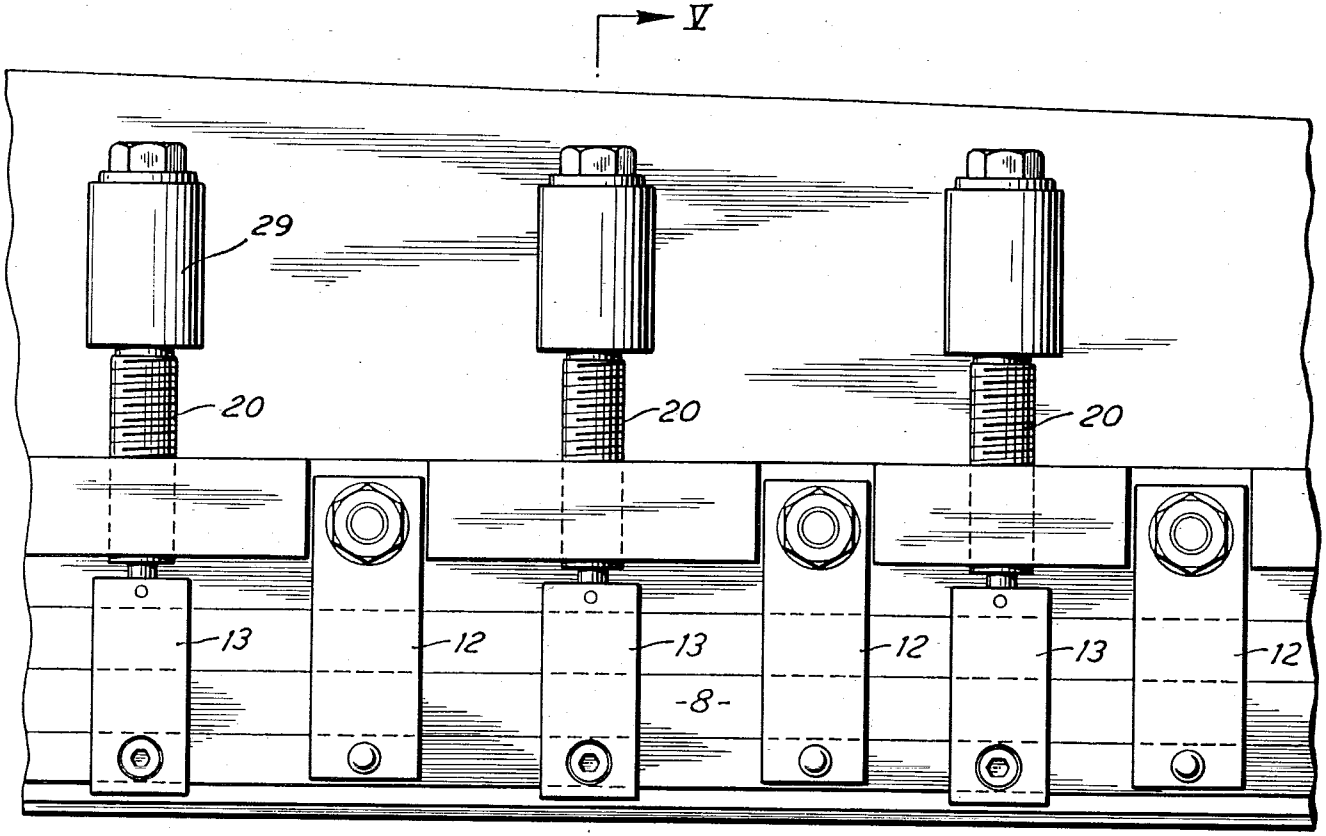
FIG. 6 is a side view in the direction of arrow VI of FIG. 5, of a portion of the seal of FIG. 5.

The main differences of FIGS. 5 and 6 from the embodiment of FIG. 3 or FIG. 4 is that an elongate channel 35 is interposed between the side of the door and the knife edge element 8. The back 36 of the channel 35 is mounted on the door by bolts 37 so that the end faces of its legs 38 form the sealing surfaces 39 on the door against which the element 8 is pressed. The total length of these sealing surfaces 39 on the door in the adjustment direction is therefore very much less than in the embodiment of FIG. 3 or FIG. 4 and is relatively small (less than 25%) compared with the overall width of the element 8 in the adjustment direction. This reduces the adhesion forces which arise due to dirtying and tend to prevent movement of the element 8. Two spaced apart sealing surfaces 39 are preferred, for stability. FIG. 5 shows that the points of contact of the spring devices 12 with the element 8 are opposite the channel 35.

Another difference of the embodiment of FIGS. 5 and 6 is that the pin 22 passes through a hole 40 in the flange 14 of the bracket 13 and bears directly on the back face 33 of the element 8. The direction of application of the force from the springs 21 is thus in line with the element 8, as seen in FIG. 5 (compare FIG. 3).

The rear end 41 of the pin projects through a hole 42 at the rear of the housing for the springs 22, so that its position relative to the hole 42 can be used as an indicator of the force being applied by the springs 22 to the sealing element 8. Initial setting and adjustment of the spring force can be quickly made as necessary by turning the sleeve 20.

The combination of the reduced area of contact between the element 8 and the door with the spring devices 20,21,22 for pressing the element 8 against the frame 7 provides an excellent sef-adjusting seal. The reduced adhesion forces allow the element 8 to move freely under the action of the springs 21 so as to follow distortion of the door and the frame 7 very well.

In the embodiment of FIGS. 5 and 6, brackets 13 may be located between the element 8 and the door, rather than on the side of the element 8 remote from the door as shown.

What is claimed is:

1. In a seal for a door for a coke oven comprising (a) an elongate knife edge element having as one long edge a knife edge which, in the closed position of the door, engages a sealing surface of the surround of the coke oven opening, (b) pressing means urging the knife edge element laterally against a sealing side-surface on the side of the door, (c) the knife edge element being movable past said side-surface in an adjustment direction so as to adjust the position of the knife edge relative to the door, and (d) the knife edge element being divided into a plurality of mutually engaging parts located one behind another in the said adjustment direction, (e) holding means adapted to hold the said parts against movement relative to each other in the adjustment direction and to restrain said parts against movement relative to the door in the lateral direction, said holding means permitting relative sliding of the parts in the longitudinal direction upon flexure of the knife edge element, the improvement wherein, the length, in the adjustment direction, of the said sealing side-surface on the door against which the knife edge element is urged by said pressing means, is less than 25% of the width of the knife edge element in the adjustment direction.

2. A seal according to claim 1 wherein said sealing side-surface on the door comprises a plurality of narrow faces spaced apart in the adjustment direction.

3. A seal according to one of claims 1 and 2, wherein there are provided, spaced apart longitudinally along the knife edge element, a plurality of spring members which urge the knife edge element towards the sealing surface on the surround of the coke oven opening, and the knife edge element is aligned with the direction of the force applied by said spring members.

4. A seal according to claim 1, wherein said holding means comprises a plurality of brackets which are mounted on the knife edge element at longitudinally spaced apart points along the knife edge element, each bracket embracing the parts of the knife edge element so as to prevent their movement apart in the adjustment direction and being secured to the outermost of said parts of the knife edge element.

5. A seal according to claim 4, wherein the bracket is secured to said outermost part of the knife edge element by a bolt which passes through the bracket and engages in a threaded hole of said part.

6. A seal according to one of the claims 4 and 5, wherein to prevent relative lateral movement of the parts of the knife edge element, each mutually abutting pair of the parts is provided respectively with at least on projection and at least one recess receiving said projection.

7. A seal according to claim 6, wherein said projection and recess are a tongue and groove.

8. A door for a coke oven having a seal according to claim 1.

9. A coke oven having a door according to claim 8.

* * * * *